US008320810B2

(12) United States Patent
Creteau et al.

(10) Patent No.: US 8,320,810 B2
(45) Date of Patent: Nov. 27, 2012

(54) BELT FUSER HAVING A PROTUBERANCE FOR AN IMAGING DEVICE

(75) Inventors: Gregory Daniel Creteau, Winchester, KY (US); Jerry Wayne Smith, Irvine, KY (US)

(73) Assignee: Lexmark International, Inc., Lexington, KY (US)

( * ) Notice: Subject to any disclaimer, the term of this patent is extended or adjusted under 35 U.S.C. 154(b) by 486 days.

(21) Appl. No.: 12/358,016

(22) Filed: Jan. 22, 2009

(65) Prior Publication Data

US 2010/0183347 A1 Jul. 22, 2010

(51) Int. Cl.
*G03G 15/20* (2006.01)

(52) U.S. Cl. ..... 399/329; 399/122; 219/216

(58) Field of Classification Search ..... 399/122, 399/329; 219/216
See application file for complete search history.

(56) References Cited

U.S. PATENT DOCUMENTS 5,267,005 A * 11/1993 Yamamoto et al. ..... 399/329
5,852,763 A * 12/1998 Okuda et al. ..... 399/329
6,157,806 A * 12/2000 Elbert et al. ..... 399/329
6,456,819 B1 * 9/2002 Abe et al. ..... 399/329
7,027,763 B2 * 4/2006 Kato et al. ..... 399/329
7,233,764 B2 * 6/2007 Naito et al. ..... 399/329
7,671,300 B2 3/2010 Lucas et al.
7,672,631 B2 3/2010 Lucas et al.
2006/0067751 A1 * 3/2006 Gilmore ..... 399/329
2008/0317522 A1 * 12/2008 Ardery et al. ..... 399/329
2009/0010686 A1 * 1/2009 Matsumoto ..... 399/324
2011/0085831 A1 * 4/2011 Hullman et al. ..... 399/329
2011/0135353 A1 * 6/2011 Creteau et al. ..... 399/329
2011/0170917 A1 * 7/2011 Yoshikawa et al. ..... 399/329
2011/0194869 A1 * 8/2011 Yoshinaga et al. ..... 399/69
2011/0200370 A1 * 8/2011 Ikebuchi et al. ..... 399/329
2011/0229200 A1 * 9/2011 Yamaguchi et al. ..... 399/122

* cited by examiner

*Primary Examiner* — David Gray
*Assistant Examiner* — G. M. Hyder

(57) ABSTRACT

A fuser has a protuberance extruding lengthwise from the surface of a heater opposite the interior surface of an endless belt and is positioned in transverse relationship to the interior surface of the endless belt. A pressure roller defines a nip with the endless belt wherein the nip has an entrance side and an exit side and wherein the position of the protuberance adjacent to the nip creates pressure upon the endless belt. The print media sheet is driven through the nip in reaction to the pressure applied by the pressure roller to the belt. The position of the protuberance and the pressure created upon the endless belt directs the lubricant from the endless belt surface to the nip.

20 Claims, 2 Drawing Sheets

BELT FUSER HAVING A PROTUBERANCE FOR AN IMAGING DEVICE

CROSS REFERENCES TO RELATED APPLICATIONS

None.

BACKGROUND

1. Field of the Invention

The present invention relates generally to image forming machines and, more particularly, to a fuser for an image forming machine with a heater having a protuberance strategically placed on the surface of the heater for maintaining adequate lubricity between the belt and the heater.

2. Description of the Related Art

An image forming machine, such as a printer, copier, fax machine, all-in-one device or multifunctional device, typically includes a heating device, such as a fuser, to fix a developing agent, such as toner, to a media sheet. The fuser typically contains a heater and an endless belt and backup pressure roll that form a nip for the media sheet to pass through. They provide heat and/or pressure to the toner to soften the toner so that it will adhere to the media sheet. The fuser belt defines an inner loop. The heater is positioned within the inner loop and in direct contact with the belt. The heater has a profile generally corresponding to the travel path of the belt to provide an area contact rather than a line contact for more efficient thermal transfer. The heater is in the form of a ceramic heater held in a heater housing positioned within the inner loop and against the belt. The fuser belt is an "idling belt" having no drive rolls within it. The belt is driven by the rotation of the backup pressure roll, through the driving association of the belt with the pressure roll at the nip.

The sliding contact between the belt and the heater can cause high friction force. Lubricants such as grease and oil have commonly been used between the belt and the heater in order to reduce this high friction force.

In the prior art a problem exists in that greases normally have a higher viscosity than oil and can form a thicker film on the belt and heater surface. This higher viscosity can cause higher frictional force and driving torque. Further, the greater film thickness can cause lower fusing capability. As the grease/oil is removed from the fuser nip by the rotating action of the belt against the glass heater surface and the shear created by this action, the lubricity between the belt and the heater becomes increasingly worse. This leads to a higher driving torque, higher belt wear, and sometimes the destruction of the belt.

Thus, there is still a need for an innovation that will prevent the grease/oil form leaving the fuser nip in order to maintain the lubricity between the belt and the heater.

SUMMARY OF THE INVENTION

The present invention meets this need by providing an innovation that strategically places a feature in the form of a protuberance on the outer surface of the heater and perpendicular to the belt such that when the belt moves along the heater surface, the incoming edge of the protuberance scrapes the grease/oil from the belt surface and keeps it in the fuser nip. As a result, the grease/oil moving towards the exits of the belt is pushed back into the fuser nip.

Accordingly, in an aspect of the present invention, a fuser for an image forming device has an endless belt with lubricant applied to the surface. The endless belt has opposite marginal side edge portions and opposite exterior and interior surfaces on the belt that extend between the opposite marginal side edge portions. Within the endless belt is a heater housing wherein the interior surface of the endless belt surrounds the heater housing lengthwise between opposite ends of the heater housing. A heater is within the heater housing and the heater has a lengthwise surface disposed in heat transfer relationship with the endless belt. A protuberance extrudes lengthwise from the surface of the heater opposite the interior surface of the endless belt and is positioned in transverse relationship to the interior surface of the endless belt. A pressure roller defines a nip with the endless belt wherein the nip has an entrance side and an exit side and wherein the position of the protuberance adjacent to the nip creates pressure upon the endless belt. The print media sheet is driven through the nip in reaction to the pressure applied by the pressure roller to the belt. The position of the protuberance and the pressure created upon the endless belt directs the lubricant from the endless belt surface to the nip.

BRIEF DESCRIPTION OF THE DRAWINGS

Figure 1:
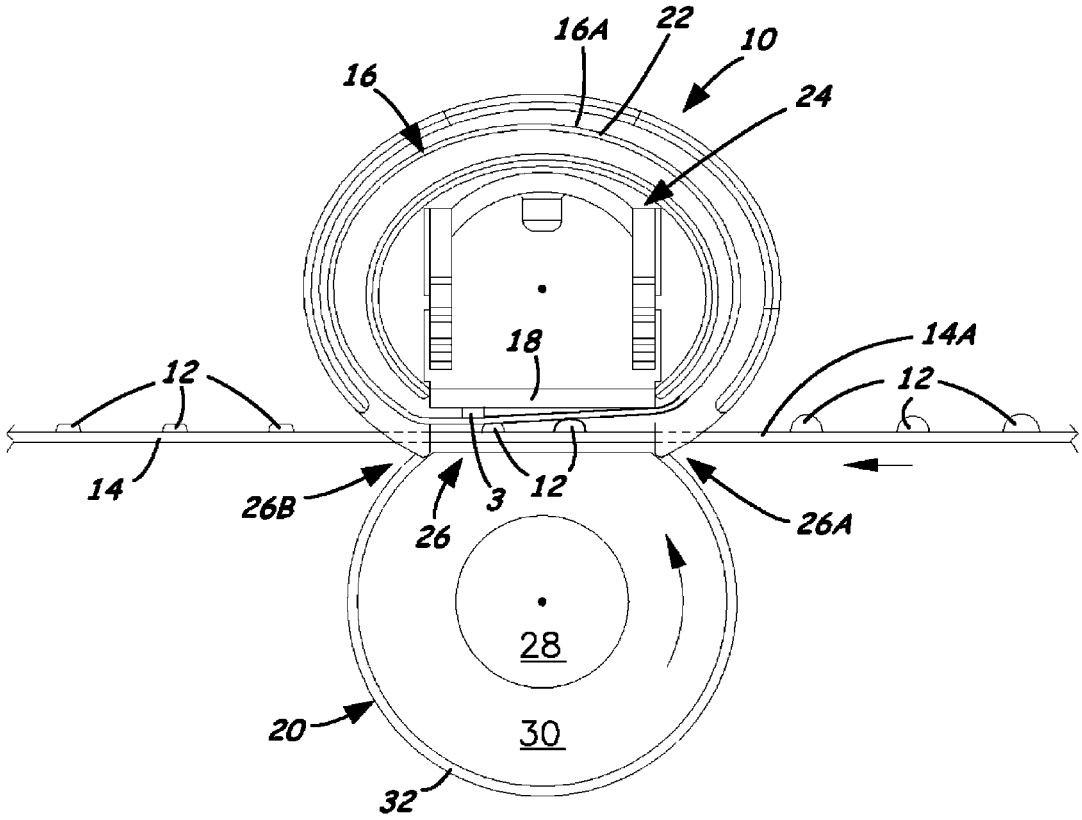

Having thus described the invention in general terms, reference will now be made to the accompanying drawings, which are not necessarily drawn to scale, and wherein:

FIG. 1 is a schematic end view of an exemplarily embodiment of a fuser of an image forming machine with a media sheet having toner thereon traveling through a nip between an endless belt and a backup pressure roll of the fuser.

Figure 2:
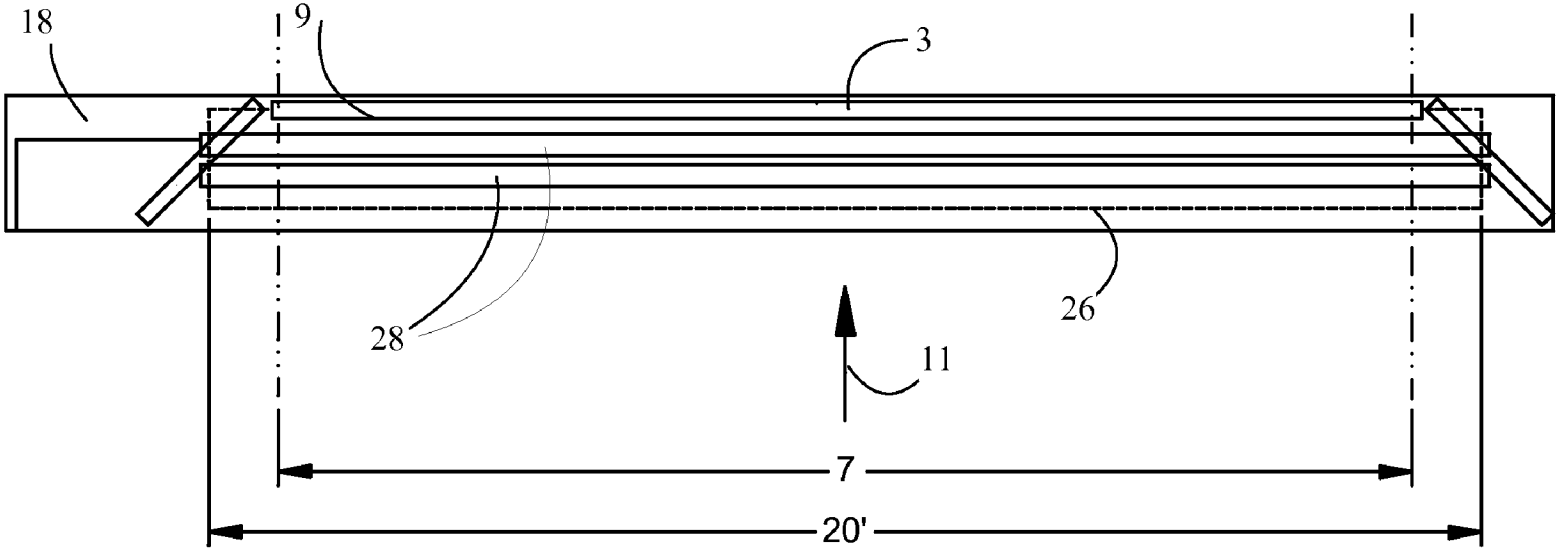

FIG. 2 is a schematic top view of the protuberance located on the outer surface of the heater.

Figure 3:
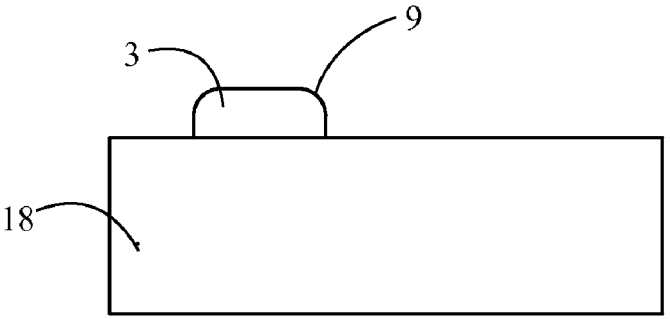

FIG. 3 is an enlarged fragmentary sectional view of the protuberance located on the outer surface of the heater.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIG. 1, there is illustrated an exemplary embodiment of a fuser, generally designated 10, of an image forming machine (not shown). The fuser 10 fixes or fuses toner particles 12 defining an image to a media sheet 14. Toner particles 12 may be monochrome particles or particles of different colors (e.g., cyan, magenta, yellow and/or black particles). The fuser 10 includes an endless belt 16, a heater 18 and a backup pressure roll 20. The belt 16 defines an inner loop 22 having a metal tube and, to improve the degree to which the belt conforms to varying heights of the various piles of toner particles, a compliant rubber layer on the base and a release coating covering the rubber layer to enhance thermal conductivity. More specifically, the belt 16 is typically a fluorpolymer layer (either in the form of a sleeve or a coating, silicone rubber molded over a flexible metal tube or a polyimide seamless tube.

The heater 18 is positioned within the inner loop 22 and in direct contact with the endless belt 16. The heater 18 has a profile (e.g. flat or curved) generally corresponding to the travel path of belt 16 to provide an area contact rather than a line contact for more efficient thermal transfer. The heater 18 may be in the form of a ceramic heater component held in a heater housing 24 positioned within the inner loop 22 of and against the belt 16. The belt 16 is somewhat loosely fit around the heater housing 24, which is a high-temperature plastic body made of a liquid crystal polymer, in one example about 22% glass and mineral filled but not limited to this combination.

The backup pressure roll 20 defines a nip 26 with the belt 16 through which the print media sheet 14 travels. The nip 26 has an entrance 26A and an exit 26B. The belt 16 is positioned adjacent the toner side 14A of the sheet 14 as it is transported through the nip 26, with the pressure roll 20 on the opposite side thereof. As known to those skilled in the art, the backup pressure roll 20 includes a metal core 28, a compliant layer 30 surrounding the core 28, and a release layer 32 surrounding the compliant layer 30. The metal core 28 may be formed from a suitable metal that provides structural rigidity and stores thermal energy, such as extruded aluminum or steel. The compliant layer 30 may be formed from a material providing compliance of pressure roll 20, and can be in the form of silicone rubber, but may be formed of other resilient materials. Additionally, the release layer 32 may be in the form of a sleeve made from a material providing suitable release properties.

The endless belt is a so-called "idling belt" having no drive rolls within its inner loop. The belt is driven by the rotation of the backup pressure roll 20 through the driving association of the belt 16 therewith in the nip 26. The print media sheet 14 is transported to the fuser 10 by a transport belt (not shown), and passes through the nip 26. During printing, the fuser 10 fixes or fuses the toner particles 12 to the toner side of 14 A of the print media sheet. The heater 18 positioned within the inner loop 22 of the endless belt 16 is energized such that the heater 18 provides a desired heat output. Heat is transferred principally via conduction from the heater 18, through the belt 16, and to the outer periphery of the backup pressure roll 20. The outer surface 16A of the belt 16 is also the surface that transfers heat to toner particles 12, for fixing or fusing an image on the print media sheet 14. The print media sheet 14 is transported through the nip 26 between the backup pressure roll 20 and the belt 16. Heat is transferred from the belt 16 to toner particles 12, to fix or fuse the image on the sheet 14, and is additionally transferred to the backside of the sheet 14 from the pressure roll 20, to assist in the fusing process. The compliant rubber layer of the belt 16 accommodates the varying thickness of toner particles 12 on the print media sheet 14.

The sliding contact between the endless belt 16 and the heater 18 can cause high friction force. Generally, a lubricant such as grease or oil is applied to the surface of the endless belt 16 to reduce this friction force. Greases normally have a higher viscosity than oil and can form a thicker film on the belt and heater surface. This higher viscosity can cause higher frictional force and driving torque. Further, the greater film thickness can cause lower fusing capability. The grease/oil is removed from the fuser nip by the rotating action of the belt against the glass heater surface. This removal and the shear created by this action, decreases the lubricity between the belt and the heater. This leads to a higher driving torque, higher belt wear, and sometimes the destruction of the belt. In the present invention, the grease/oil moving towards the exits of the endless belt is pushed back into the fuser nip.

Turning now to FIG. 2, which is a top view of the protuberance 3 located on the heater 18 shown in FIG. 1, the heater 18 has a protuberance 3 on the outer surface of the heater 18 that substantially overcomes the lubricity problem at the fuser nip. As shown in FIGS. 1 and 2, the heater 18 has a protuberance 3 on the outer surface of the heater 18 that is perpendicular to the endless belt 16. When the endless belt 16 moves along the heater 18 surface, the incoming edge of the protuberance 3 scrapes lubricant such as grease or oil (not shown) from the surface of the endless belt 16 and keeps the lubricant within the fuser nip 26. As shown in FIG. 2, the leading edge 9 of the protuberance 3 extruding from the outer surface of the heater 18 is perpendicular to the paper moving direction 11 and extends longer than the paper width 7. The leading edge 9 of protuberance 3 is slightly inside of the nip 26 formed by the length 20' of backup roller 20. Resistive stripes 28 are energized via an AC line voltage in order to generate the heat required to melt the toner to the printed media.

Turning now to FIG. 3, which is an expanded side view of the protuberance 3 located on the outer surface of the heater 18 shown in FIG. 2, the leading edge of the protuberance 9 is located at the trailing edge of the fuser nip 26 (not shown in FIG. 3), which is at the end of the backup roller (not shown). The leading edge 9 is preferably less than 1 mm in height and preferably between 0.05 and 0.1 mm in width. The protuberance 3 can be created in several forms by those skilled in the art including but not limited to a series of thick film printing sequences to create a bump with a height in the tens to hundreds of microns range or a glass rod attached to the outer surface of the heater 18 covered with one or more thick film printed glass layers. Thermal coefficient of expansion would be considered in the selection of the protuberance 3 material (s).

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A fuser for an image forming device, comprising:

an endless belt having opposite marginal side edge portions and opposite exterior and interior surfaces on said belt extending between said opposite marginal side edge portions wherein lubricant is applied to said endless belt interior surface;

a heater housing disposed within said endless belt such that said interior surface thereof surrounds said housing lengthwise between opposite ends of said housing;

a heater disposed within said heater housing and having a lengthwise surface disposed in heat transfer relationship with said endless belt;

a protuberance extending from the lengthwise surface of said heater opposite the interior surface of said endless belt and positioned in transverse relationship to the interior surface of said endless belt; and a pressure roller defining a nip with said belt wherein said nip has an entrance side and an exit side, wherein the position of said protuberance at the nip creates pressure upon said endless belt and wherein pressure is applied by the pressure roller to the belt to drive a print media sheet through the nip, thereby directing said lubricant from said endless belt surface within said nip;

wherein said protuberance comprises a plurality of thick film glass layers and extends substantially across a length of said heater from said lengthwise surface thereof.

2. The fuser of claim 1 wherein said protuberance has a leading edge positioned at said exit side of said nip.

3. The fuser of claim 2 wherein said leading edge is less than 1 mm in height.

4. The fuser of claim 1 wherein said protuberance further comprises a glass rod covered in said thick film glass layers.

5. The fuser of claim 4 wherein said glass rod has a dimensional cross section that is circular.

6. The fuser of claim 4 wherein said glass rod has a dimensional cross section that is rectangular.

7. A fuser for an image forming device, comprising:

an endless belt having opposite marginal side edge portions and opposite exterior and interior surfaces on said belt extending between said opposite marginal side edge portions wherein lubricant is applied to said endless belt interior surface;

a heater housing disposed within said endless belt such that said interior surface thereof surrounds said housing lengthwise between opposite ends of said housing;

a heater disposed within said heater housing and having a lengthwise surface disposed in heat transfer relationship with said endless belt;

a protuberance extending from the lengthwise surface of said heater opposite the interior surface of said endless belt and positioned in transverse relationship to the interior surface of said endless belt; and a pressure roller defining a nip with said belt wherein said nip has an entrance side and an exit side, wherein the position of said protuberance at the nip creates pressure upon said endless belt and wherein pressure is applied by the pressure roller to the belt to drive a print media sheet through the nip, thereby directing said lubricant from said endless belt surface within said nip;

wherein said protuberance has a leading edge positioned at said exit side of said nip and wherein a distance from said leading edge to a trailing edge of said protuberance is from about 0.05 to about 0.1 mm in width.

8. A fuser heater for an image forming device, comprising:

a ceramic substrate having a first surface;

one or more resistive traces disposed along the first surface of the ceramic substrate; and a protuberance extending from the first surface of the ceramic substrate adjacent to the one or more resistive traces, and extending from a first end portion of the ceramic substrate to a second end portion thereof, wherein the protuberance has a width between about 0.05 mm and about 0.1 mm.

9. The fuser heater of claim 8, wherein the protuberance includes a leading edge disposed nearer a longitudinal center portion of the ceramic substrate than other portions of the protuberance, the leading edge being less than about 1 mm in height.

10. The fuser heater of claim 8, wherein the protuberance comprises a glass material.

11. The fuser heater of claim 8, wherein the protuberance comprises a plurality of thick film layers.

12. A fuser for an image forming device, comprising:

an endless belt having opposite marginal side edge portions and opposite exterior and interior surfaces on the belt extending between the opposite marginal side edge portions;

a lubricant disposed along the interior surface of the belt;

a heater housing disposed within the endless belt such that the interior surface thereof surrounds the housing lengthwise between opposite ends of the housing;

a heater disposed within the heater housing and having a lengthwise surface disposed in heat transfer relationship with the endless belt; and a protuberance extending from the lengthwise surface of the heater from a first longitudinal end portion of the heater to a second longitudinal end portion thereof, the protuberance disposed opposite the interior surface of the endless belt and positioned in transverse relationship to the interior surface thereof, the protuberance having a width between about 0.05 mm and about 0.1 mm.

13. The fuser of claim 12, further comprising:

a pressure roller defining a nip with the belt wherein the nip has an entrance side and an exit side, wherein the position of the protuberance at the nip creates pressure upon the endless belt and wherein pressure is applied by the pressure roller to the belt to drive a print media sheet through the nip, thereby directing the lubricant from the endless belt surface within the nip.

14. The fuser of claim 13, wherein the protuberance has a leading edge positioned at the exit side of the nip.

15. The fuser of claim 14, wherein the leading edge protuberance has a height less than about 1 mm.

16. The fuser of claim 12, wherein the protuberance comprises a glass rod covered in a plurality of thick film glass layers.

17. The fuser of claim 16, wherein the glass rod has a substantially rectangular cross section.

18. The fuser heater of claim 8, wherein the protuberance comprises a glass rod covered in a plurality of thick film glass layers.

19. The fuser heater of claim 18, wherein the glass rod has a substantially rectangular cross section.

20. The fuser heater of claim 18, wherein the glass rod has a substantially circular cross section.

* * * * *